United States Patent [19]

Whittaker et al.

[11] 4,368,919

[45] Jan. 18, 1983

[54] HOLDER ASSEMBLIES FOR SENSITIZED CUTTER TOOLS ON MINING MACHINES

[75] Inventors: Raymond A. Whittaker; Raymond Lukaszewicz; John A. Ford, all of Burton-on-Trent, England

[73] Assignee: Coal Industry (Patents) Limited, London, England

[21] Appl. No.: 233,145

[22] Filed: Feb. 10, 1981

[30] Foreign Application Priority Data

Feb. 26, 1980 [GB] United Kingdom ..... 8006400

[51] Int. Cl.[3] ..... E21C 35/08

[52] U.S. Cl. ..... 299/1; 299/85

[58] Field of Search ..... 299/1, 91-93, 299/85; 175/413; 407/40, 41

[56] References Cited

U.S. PATENT DOCUMENTS 3,550,959 12/1970 Alford ..... 299/1

3,841,708 10/1974 Kniff et al. ..... 175/413 X 4,057,294 11/1977 Krekeler ..... 299/93

*Primary Examiner*—Ernest R. Purser

*Attorney, Agent, or Firm*—Stevens, Davis, Miller & Mosher

[57] ABSTRACT

A holder assembly for a sensitized cutter tool on a cutter head of a mining machine, comprises an outer component mountable on the cutter head and defining a recess and an inner component engageable within the recess by movement in at least one direction, the inner component providing holder means for the sensitized cutter tool, the outer component defining an abutment face within the recess for engagement by a corresponding abutment face defined by the inner component, the abutment faces being inclined to said at least one direction of movement.

6 Claims, 3 Drawing Figures

HOLDER ASSEMBLIES FOR SENSITIZED CUTTER TOOLS ON MINING MACHINES

This invention relates to cutter tool holder assemblies for retaining sensitized cutter tools on a cutter head of a mining machine. A sensitized cutter tool enables a cutting characteristic of rock and/or mineral to be sensed as the tool is cutting.

In particular, although not exclusively, the present invention relates to holder assemblies for sensitized cutter tools mounted on rotary cutter heads of mining machines.

One prior known rotary cutter is described in the assignee's prior British patent specification No. 1,219,159. Such a rotary cutter for a mineral mining machine comprised a rotary cutter head, cutter tools fixedly mounted on, and distributed around, the head, a cutter tool resiliently mounted on the head and so positioned relatively to one of the fixedly mounted cutter tools that the penetration of the resiliently mounted tool over at least a substantial part of its cutting path is shallow and constant, and means which are sensitive to relative movement between the resiliently-mounted tool and said one fixed tool and which are adapted to derive a signal indicative of said relative movement.

The movably mounted cutter tool and said one fixed tool were mounted in a common housing which was releasably securable to the cutter head and which comprised a housing carrying holders for the two above mentioned tools. In use, the housing was generally box-shaped having substantially parallel opposed sides and was accommodated in a recess having substantially parallel opposed sides, the housing being retained in the recess by bolts accommodated in holes provided in the walls of the recess and fixedly engaged in threaded bores in the housing.

Unfortunately, during cutting operations the housing tended to be held stationary against the action of the substantial cutting forces by the bolts only. Consequently, problems were encounted in trying to retain the bolts tightly screwed in the threaded bores. In practice the bolts rapidly unscrewed or deformed permitting movement of the housing and tending to make the derived signal unreliable.

An object of the present invention is to provide a holder assembly for a sensitized cutter tool which tends to overcome or reduce the above mentioned problem.

According to the present invention a holder assembly for a sensitized cutter tool on a cutter head of a mining machine comprises an outer component for mounting on the cutter head and defining a recess and an inner component engageable within the recess by movement in at least one direction and having cutter tool holder means for the sensitized cutter tool, the outer component defining an abutment face within the recess for engagement by a corresponding abutment face defined by the inner component, the abutment faces being inclined to said at least one direction of movement.

Preferably, the outer component defines at least one further abutment face within the recess for engagement by a corresponding further abutment face defined by the inner components, the further abutment faces substantially lying in the said at least one direction of movement.

Preferably, the outer component defines a keyway for engagement by a key on the inner component.

Advantageously, the keyway is formed in a base margin of the recess.

Preferably, an outer margin of the inner component is stepped to define said corresponding abutment face.

Advantageously, opposed outer margins of the inner component are stepped to define an interrupted said corresponding abutment face.

By way of example only, one embodiment of the present invention will be described with reference to the accompanying drawings, in which.

Figure 1:
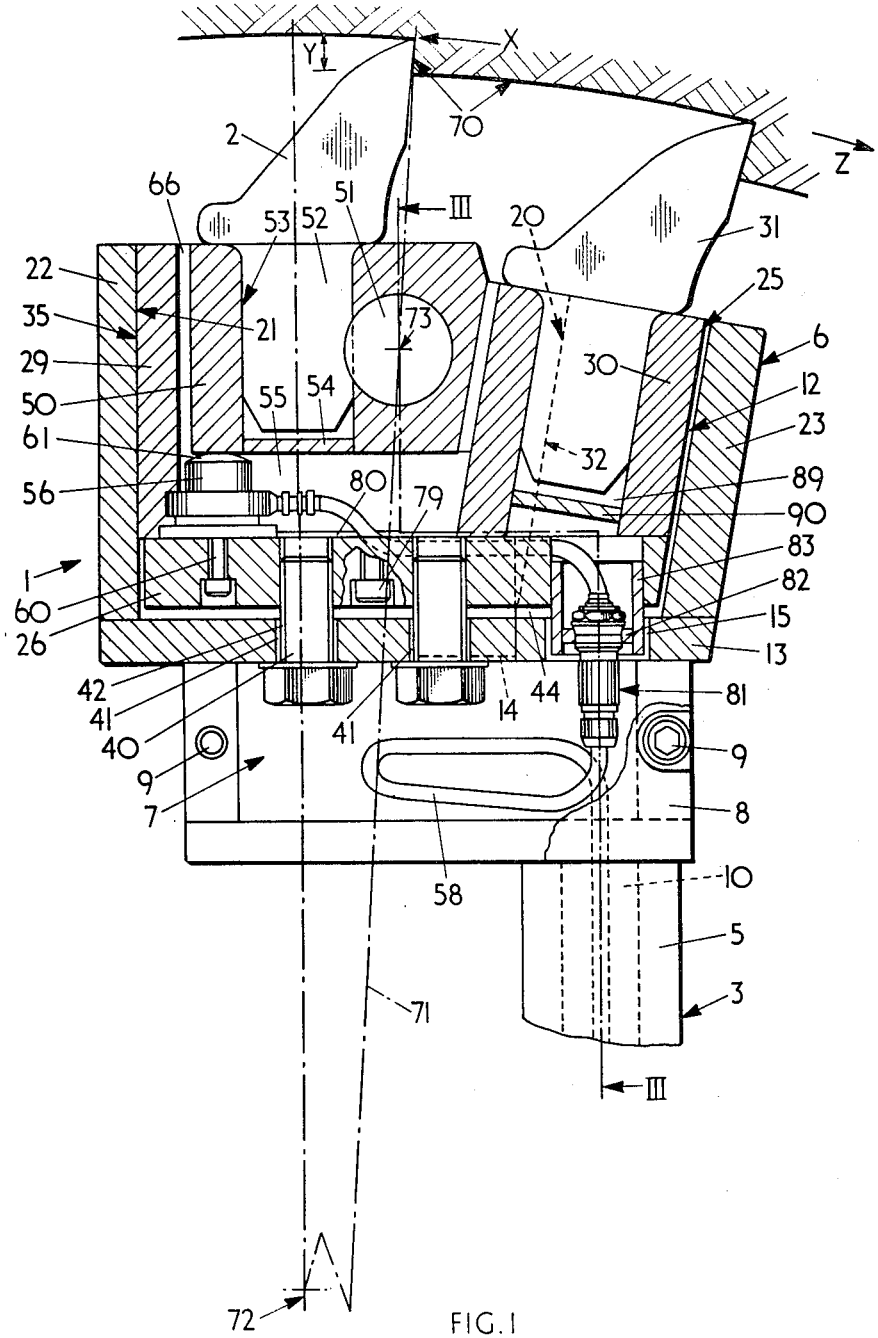
FIG. 1 is a sectional side elevation through a holder assembly for a sensitized cutter tool on a cutter head of a mining machine, the section substantially being taken along line I—I of FIG. 2.

The drawings show a holder assembly 1 for a sensitised cutter tool 2 (omitted on FIGS. 2 and 3), mounted on a mineral rotary cutter head 3 (only portions of a hub 4 and of an upstanding cut mineral guide 5 are shown). In use, the cutter head 3 is drivably mounted on a drive shaft assembly (not shown) of a mineral mining machine which during cutting operations traverses to and fro along a longwall face winning mineral from the working face. The drive shaft assembly may be mounted on the machine body or alternatively, it may be mounted on an arm or boom pivotally mounted with respect to the machine body.

In different installations, the present invention may be mounted on a rock or rock/mineral cutting machine.

The sensitized cutter tool 2 which enables a cutting characteristic of the rock and/or mineral to be sensed is described in more detail later in the specification.

The holder assembly 1 comprises an outer component 6 having a generally open box-like formation fixedly secured to the upstanding cut mineral guide 5 by welding and including an electrical connection compartment 7 having a removable side lid 8 (only a part of which is shown in FIG. 1) retained in a closed position by two bolts 9. The compartment 7 communicates with a passage 10 extending along the upstanding guide 5 and a further passage 11 extending around the hub to the base of the upstanding guide.

The compartment 7 also communicates with a recess 12 defined by the box-like formation of the outer component 6. The base 13 of the outer component 6 is provided with a relatively short slotted keyway 14 as well as a passage 15 providing the previously mentioned electrical connecting passage with the component 7.

Figure 2:
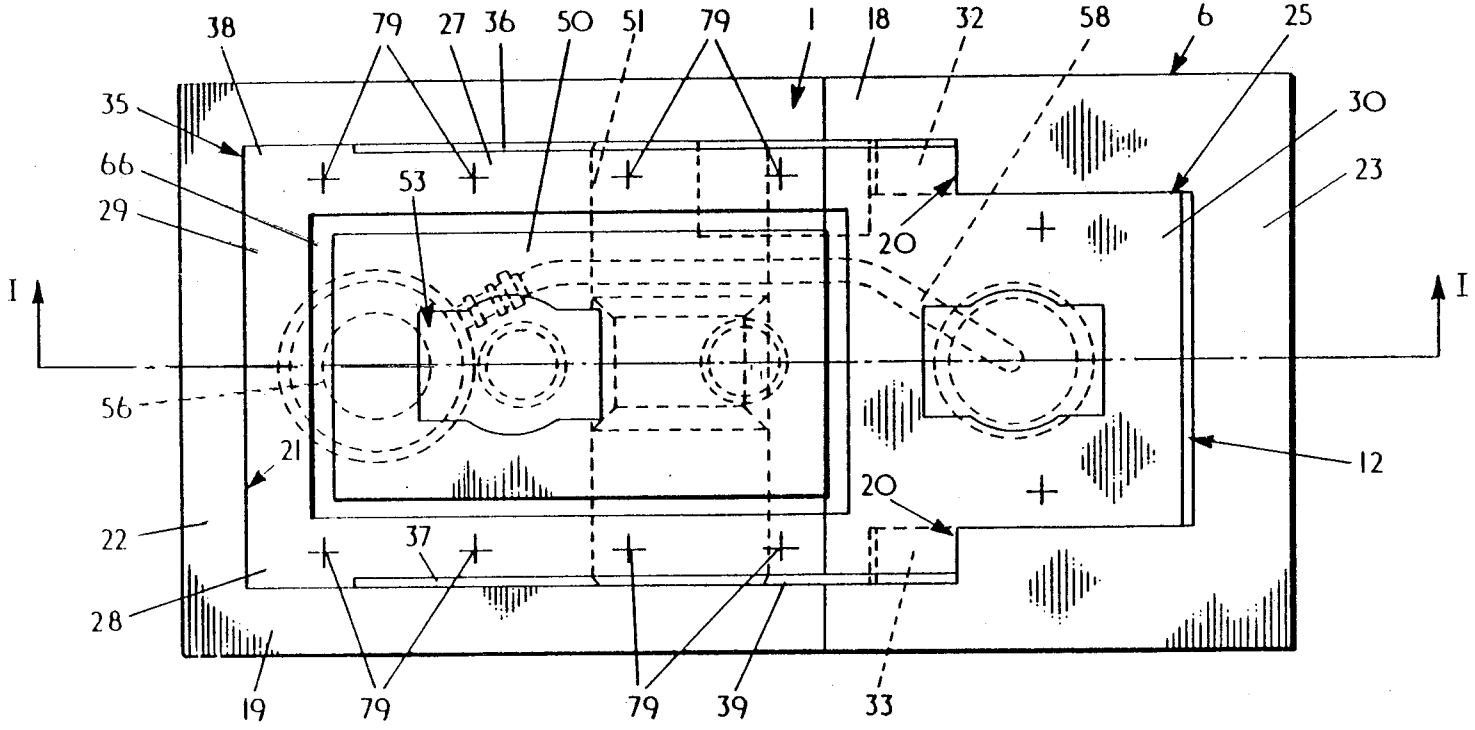
FIG. 2 is an incomplete plan of the holder assembly of FIG. 1.

As seen in FIG. 2 the two opposed side face plates 18 and 19 of the outer component 6 are stepped to define an interrupted abutment face 20 which as indicated in FIGS. 1 and 2 is inclined relative to the base 13.

A further abutment face 21 is defined by the end face plate 22 of the outer component. The leading margin of the outer component 6 is formed by a face plate 23 which as seen in FIG. 1 is inclined relatively to the base 13.

An inner component 25 having a general outer shape somewhat similar to the inner profile defined by the recess 12 is engageable within the recess, the inner component comprising a base plate 26, two opposed side face plates 27 and 28 and a rear face plate 29. The front of the inner component is closed by a tool holder 30 for a fixedly mounted cutter tool 31, the tool holder being integral with the two face plates 27 and 28 and arranged to project outwardly beyond the leading end faces 32 and 33 of the end face plates which end faces are inclined relatively to the base plate 26 so as to form an interrupted abutment face co-operating with the inclined interrupted abutment face 20 defined by the outer component 6.

The two opposed side plates 27 and 28 are secured to the base 26 by bolts 79, the lower margins of the two plates 27, 28 abuting lugs 80 upstanding from the base 26.

The rear face plate also defines a further abutment face 35 for co-operating with said further abutment face 21 defined by the end face plate 22 of the outer components.

From FIG. 2 it will be appreciated that the inner component 25 is inserted into the recess 12 defined by the outer component 6 in a direction substantially normal to the recess base 13 until the abutment faces 32, 33 and 35 abut the corresponding abutment faces 20 and 21, respectively. Once the abutment faces are in contact the inner component 25 is prevented from movement in a direction substantially normal to the abutment face 20, ie in a direction substantially in line with the substantial cutting forces exerted on the cutting tools 31 and 2 as will be explained later in this specification.

The outward facing faces of the two opposed side face plates 27 and 28 are cut away at 36 and 37 such that only the rear margins 38 and 39 of these plates abut the inward facing opposed side face of the side face plates 18 and 19. Thus, the inner component 25 tends to be held against movement in a direction transverse to the said direction substantially in line with the substantial cutting forces.

The inner component 25 is releasably retained in the recess 12 defined by the outer component by two bolts 40 the heads of which abut the lower most face of the base 13 of the outer component 6 and the threaded shafts of which pass through bores 41 provided in the base 13 to fixedly engage in threaded bores 42 provided in the base plate 26 of the inner component 25. The bolts 40 are inserted into the locating position as shown in FIG. 1 via the previously mentioned electrical connecting compartment 7.

Figure 3:
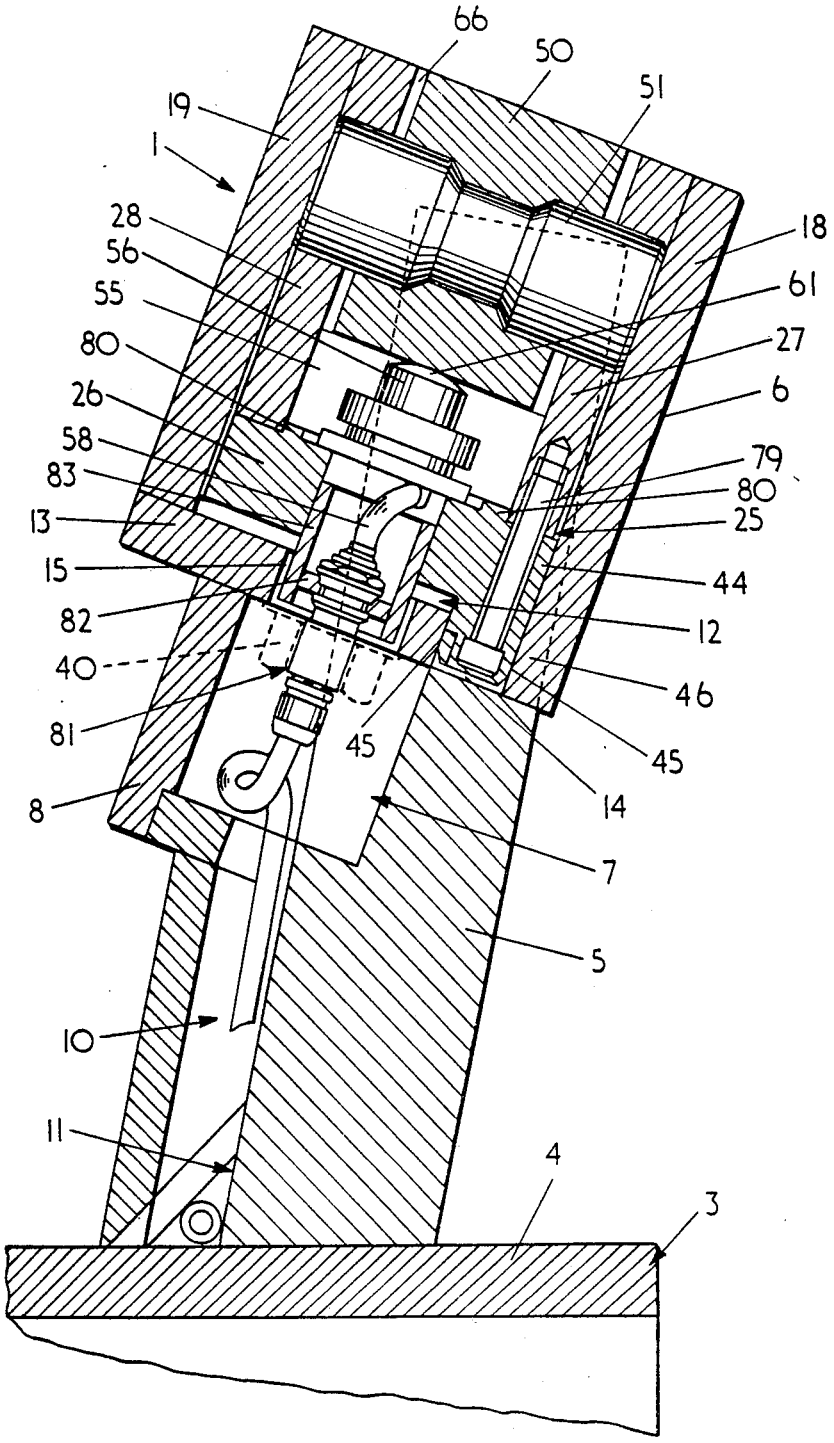
FIG. 3 is an incomplete sectional view substantially taken along line III—III of FIG. 1.

The base plate 26 of the inner component is provided with a key 44 shown longitudinally out of position in FIG. 3 for the sake of clarity for engagement in the previously mentioned slotted keyway 14 provided in the base 13 of the outer component, the outward facing side faces 45 of the key abutting the associated inward facing side faces 46 on the keyway. Thus, the inner component 25 is fixedly retained within the recess 12 and is able to withstand the substantial cutting forces.

The inner component 25 supports a tool holder 50 for the previously mentioned sensitized cutter tool 2, the holder 50 being secured to the side face plates 27 and 28 of the inner component by a substantial pivot pin 51 which bridges the two side plates. As seen in FIG. 2 the central margin of the pivot pin is stepped so as to avoid interference with the rectangular shank 52 of the cutter tool 2 which shank is releasably fixedly engaged within a generally rectangular passage 52 provided in the holder 50. The lower most end of the passage 53 is closed by a plate 54 which prevents broken rock and/or mineral particles penetrating into a chamber 55 which houses a sensor 56 for sensing cutting forces exerted on the sensitized cutter tool 2 as will be explained later in this specification and which is at least partly filled with potting compound. The sensor 56 is adapted to derive a signal indicative of the cutting characteristics of the rock and/or mineral and to feed the derived signal along an electric cable 58 which extends along the chamber 55 and via the previously mentioned passages 15, 7, 10 and 11 to control means arranged to control the cutting horizon of the cutter head in response to the derived signal. An electrical connector 81 is located in the passage 15, one portion of the connector 81 being fixedly secured to an annulus 82 fixedly secured to a locating bush 83 secured to the base plate 26 of the inner component 25. The holder 30 for the cutter tool 31 has a recess 89 for receiving the tool shank, the base of the recess being closed by a plate 90.

The sensor 56 is retained in position on the base 13 by a locating bolt 60, the sensitive head 61 of the sensor being abutted by the base of the holder 50 substantially to prevent pivotal movement of the holder about the pivot pin 51 in an anti-clockwise direction as seen in FIG. 1. Thus, any cutting reaction taken by the sensitized cutter tool 2 while cutting through the mineral and/or rock and tending to pivot to tool holder 50 about the pivot pin 51 is sensed by the sensitive head 61 of the sensor which as previously mentioned derives a signal indicative of the cutting force. In FIG. 1 with the cutter head rotating in a clockwise direction as indicated by arrow Z the cutting force exerted on the sensitized cutter tool 2 is indicated by arrow X. It will be appreciated that the fixedly mounted leading cutter tool 31 cuts mineral and/or rock to leave a cut profile 70. Thereby, the sensitized cutter tool 2 which follows close behind, and in the same cutting path as, the cutter tool 31 is required to cut a relatively shallow and substantially constant depth of cut (indicated by Y) for at least a portion of its cutting traverse. Typically the depth of cut taken by the sensitized cutter tool 2 is 12.5 mm. Since the sensitized cutter tool cuts a substantially constant depth of mineral and/or rock it follows that any substantial variations in the cutting reaction exerted on the cutter tool accrues from variations in the cutting characteristic of material being cut. Consequently, it frequently is possible to identify a cutting characteristic pattern within the band or seam of material being cut by the rotary cutter head and by comparing the cutting characteristic pattern derived from the signal fed from the sensor 56 with a preselected desired pattern to steer the cutter head to cut within a desired cutting horizon.

The line of reaction between the sensor head 61 of the sensor means and the holder 50 substantially is normal to the direction of the cutting reaction on the sensitized cutter tool.

FIG. 1 shows that the cutting margin 70 of the sensitized cutter tool 2 lies along a line 71 extending through the rotational axis 72 of the cutter head 3 (the axis 72 being shown out of position in FIG. 1) and through the pivotal axis 73 of the pivot pin 51. Such an arrangement tends to ensure that only cutting reaction forces in the direction indicated by arrow X are sensed by the Sensor 56. Other unpredictable and undesired forces derived during cutting which tend to have substantial component forces acting in a direction substantially normal to direction X tend to act through the pivotal axis 73 and therefore tend not to affect sensor 56.

Typically, the sensor 56 is a piezoelectric sensor as for example a 200 A20 Impact Transducer manufactured by PCB Piezotronics Inc. of Buffalo New York and marketed in the United Kingdom by Technimeasure, Dell House, Kastern Dene, Hazemore, High Wycombe, H8157BT.

Alternatively, the sensor may comprise a strain gauge device.

As shown in the drawings, a resilient pad 66 is provided around the pivotally mounted holder 30, the resilient pad tending to act to preload the sensor 56. Also, the resilient pad tends to prevent broken rock and/or mineral particles entering the sensor chamber 55.

In operation, the assembled inner component 25 is located in the recess 12 of the outer component 6 by relative movement of the inner component in a direction substantially normal to the cutting direction. Once the inner component is located in the recess 12 with the abutment faces 20 and 32 and 33 and 21 and 35 in engagement the bolts 40 are located in position to fixedly secure the components together. The bolts 40 are located in position via the electrical compartment 7 with the temporary removal of the compartment lid 8. Also, the two components of the electrical connector 81 are connected and the picks 2 and 31 placed in their respective holders 50 and 30.

Thus, during the cutting operation, the transient cutting characteristics acting on the sensitized cutter tool 2 are sensed by the sensor 56 which derives a signal measurably indicative of the sensed cutting characteristic. This derived signal is fed to a machine steering control and is compared with a signal indicative of the angular position of the rotating sensitized cutter tool 2 and a cutting characteristic pattern derived which is compared with a preselected desired cutting characterisitc pattern. The comparison of the derived and the desired pattern is used to steer the cutting head along a desired cutting horizon. The line of reaction between the sensor head and the holder substantially is normal to the direction of the cutting reaction on the sensitized cutter tool.

Alternatively, instead of comparing cutting characteristic patterns it may be preferred in some installations to compare cutting characteristic peaks. For example, if it is desired to cut a relatively hard rock adjacent to a mineral seam boundary or at a pre-known height within the mineral seam an associated peak signal could be used to steer the machine.

As the cutting force acting on the sensitized cutter tool 2 in the direction X fluctuates the resultant force of the pivotally mounted holder 50 on the sensor 56 varies correspondingly and thereby signal indication of the cutting force is derived.

From the above description it will be appreciated that the present invention provides equipment which tends to overcome or reduce problems associated with prior known equipment.

We claim:

1. A holder assembly for a sensitized cutter tool on a cutter head of a mining machine, comprising a cutter tool holder component for the sensitized cutter tool, an outer component for mounting on the cutter head and defining a recess, an inner component engageable within the recess by movement in at least one direction, pivot mounting means for attaching said cutter tool holder component to the inner component, the outer component defining an abutment face within the recess for engagement by a corresponding abutment face defined by the inner component, the abutment faces being inclined to said at least one direction of movement, and mechanical means for fixedly retaining the inner and outer components in position with the two abutment faces in engagement.

2. An assembly as claimed in claim 1, in which the outer component defines at least one further abutment face within the recess for engagement by a corresponding further abutment face defined by the inner component, the further abutment faces substantially lying parallel to said at least one direction of movement.

3. An assembly as claimed in claim 2, in which the outer component defines a keyway for engagement by a key on the inner component.

4. An assembly as claimed in claim 3, in which the keyway is formed in a base margin of the recess.

5. An assembly as claimed in claim 4, in which an outer margin of the inner component is stepped to define said corresponding abutment face.

6. An assembly as claimed in claim 5, in which opposed outer margins of the inner component are stepped to define an interrupted said corresponding abutment face.

* * * * *